US009382081B2

(12) United States Patent
Hiroi

(10) Patent No.: US 9,382,081 B2
(45) Date of Patent: Jul. 5, 2016

(54) IMAGE FORMING APPARATUS

(71) Applicant: Oki Data Corporation, Tokyo (JP)

(72) Inventor: Masakazu Hiroi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/583,137

(22) Filed: Dec. 25, 2014

(65) Prior Publication Data

US 2015/0175368 A1 Jun. 25, 2015

(30) Foreign Application Priority Data

Dec. 25, 2013 (JP) ..... 2013-268120

(51) Int. Cl.

| | |
|---|---|
| ***B65H 7/04*** | (2006.01) |
| ***B65H 3/44*** | (2006.01) |
| ***B65H 7/02*** | (2006.01) |
| ***B65H 7/20*** | (2006.01) |
| ***B65H 5/06*** | (2006.01) |
| ***B65H 5/26*** | (2006.01) |
| ***G03G 15/00*** | (2006.01) |

(52) U.S. Cl.

CPC ..... *B65H 3/44* (2013.01); *B65H 5/062* (2013.01); *B65H 5/26* (2013.01); *B65H 7/02* (2013.01); *B65H 7/04* (2013.01); *B65H 7/20* (2013.01); *G03G 15/6508* (2013.01); *B65H 2405/332* (2013.01); *B65H 2511/22* (2013.01); *B65H 2511/30* (2013.01); *B65H 2511/414* (2013.01); *B65H 2513/511* (2013.01); *B65H 2515/34* (2013.01); *B65H 2701/1311* (2013.01); *B65H 2701/1313* (2013.01); *B65H 2801/06* (2013.01)

(58) Field of Classification Search

CPC ..... B65H 7/04; B65H 7/14; B65H 2511/30

USPC ..... 271/9.03, 9.05, 9.06

See application file for complete search history.

(56) References Cited

U.S. PATENT DOCUMENTS

| | | | | |
|---|---|---|---|---|
| 4,265,440 | A * | 5/1981 | Shibazaki | B65H 3/44 271/259 |
| 4,484,734 | A * | 11/1984 | Tsudaka et al. | 271/9.03 |
| 4,918,489 | A * | 4/1990 | Inage et al. | 399/391 |
| 7,380,780 | B2 * | 6/2008 | Sasaki | G03G 15/6508 271/9.02 |
| 7,480,467 | B2 * | 1/2009 | Ueki et al. | 399/23 |
| 2004/0061280 | A1 * | 4/2004 | Sciurba | B65H 1/18 271/152 |
| 2009/0166949 | A1 * | 7/2009 | Unno | 271/9.03 |
| 2010/0052243 | A1 * | 3/2010 | Kishimoto | G03G 15/6508 271/9.01 |
| 2012/0286465 | A1 * | 11/2012 | Ooba | B65H 3/44 271/9.01 |

FOREIGN PATENT DOCUMENTS

JP 2002-323839 A 11/2002

* cited by examiner

*Primary Examiner* — Jeremy R Severson

(74) *Attorney, Agent, or Firm* — Muncy, Geissler, Olds & Lowe, P.C.

(57) ABSTRACT

An image forming apparatus includes a medium container that contains media, a sheet feeding controller that feeds the media one sheet by one sheet, which is contained in the medium container, a detection part that detects a remaining amount of the media contained in the medium container, and a searching part that searches for another medium container that contains media that is the same as the media contained in the medium container. The sheet feeding controller, when the detection part detects that the remaining amount of the media contained in the medium container has reached a predetermined amount, feeds one of the media, which is contained in the another medium container that is found by the searching part, to a predetermined position.

19 Claims, 9 Drawing Sheets

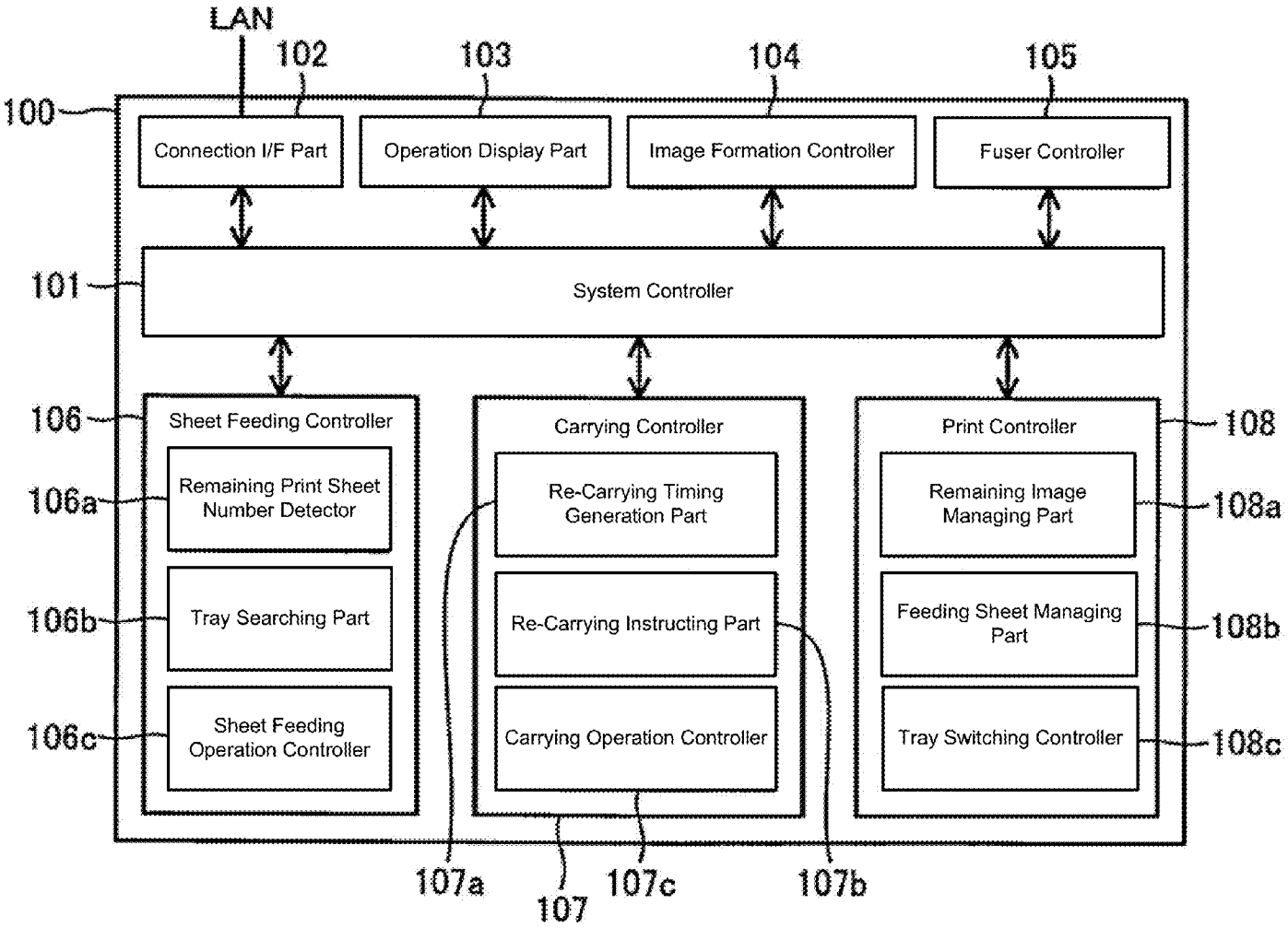
Fig. 1
LAN
102
Connection I/F Part
103
Operation Display Part
104
Image Formation Controller
105
Fuser Controller
100
101
System Controller
106
Sheet Feeding Controller
106a
Remaining Print Sheet Number Detector
106b
Tray Searching Part
106c
Sheet Feeding Operation Controller
107
Carrying Controller
107a
Re-Carrying Timing Generation Part
107b
Re-Carrying Instructing Part
107c
Carrying Operation Controller
108
Print Controller
108a
Remaining Image Managing Part
108b
Feeding Sheet Managing Part
108c
Tray Switching Controller

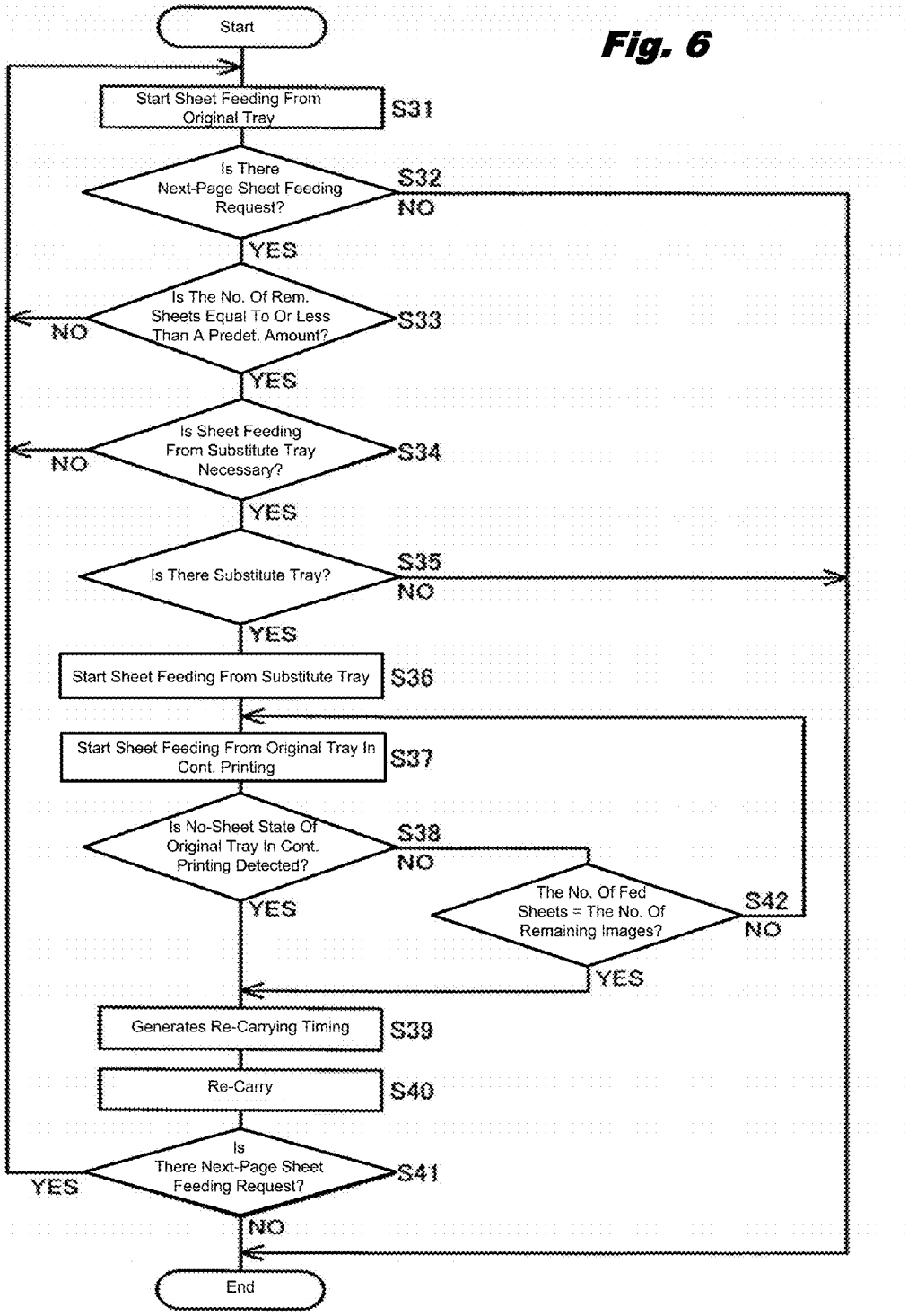
Fig. 6
Start
Start Sheet Feeding From Original Tray
S31
Is There Next-Page Sheet Feeding Request?
S32
NO
YES
Is The No. Of Rem. Sheets Equal To Or Less Than A Predet. Amount?
S33
NO
YES
Is Sheet Feeding From Substitute Tray Necessary?
S34
NO
YES
Is There Substitute Tray?
S35
NO
YES
Start Sheet Feeding From Substitute Tray
S36
Start Sheet Feeding From Original Tray In Cont. Printing
S37
Is No-Sheet State Of Original Tray In Cont. Printing Detected?
S38
NO
YES
The No. Of Fed Sheets = The No. Of Remaining Images?
S42
NO
YES
Generates Re-Carrying Timing
S39
Re-Carry
S40
Is There Next-Page Sheet Feeding Request?
S41
YES
NO
End

IMAGE FORMING APPARATUS

CROSS REFERENCE

The present application is related to, claims priority from and incorporates by reference Japanese Patent Application No. 2013-268120, filed on Dec. 25, 2013.

TECHNICAL FIELD

The present invention relates to an image forming apparatus that is provided with a plurality of sheet feeding trays that contain media.

BACKGROUND

A conventional image forming apparatus adopts an intermediate transfer method in which an image formation path is long. When a sheet feeding tray as a medium container is close to a transfer position of an image, it is necessary to start image formation before feeding a sheet from the sheet feeding tray. In order to maintain productivity of image formation even for such a positional relation, printing is performed by shortening an inter-sheet distance. However, there is a problem that, for example, when it is detected that there is no sheet in the sheet feeding tray, a formed image is wasted. In order to solve the problem, a number of remaining sheets of the sheet feeding tray is detected, and when the number of the remaining sheets reaches a predetermined amount, the inter-sheet distance is increased to be larger than that of normal setting and the timings for starting a sheet feeding operation and for starting an image formation operation are reversed (for example, see Patent Document: Japanese Patent Laid-Open Publication No. 2002-323839).

However, in the conventional technology, there is a problem that, when the number of sheets of the remaining medium has reached the predetermined amount, in order to increase the inter-sheet distance to be larger than that of normal setting, a transfer belt and a photosensitive body are caused to rotate more than that during normal printing and processing capability is reduced. A purpose of the present invention is to solve such a problem to suppress reduction in the processing capability even when the number of sheets of the remaining medium has reached a predetermined amount.

SUMMARY

An image forming apparatus disclosed in the application includes a medium container that contains media, a sheet feeding controller that feeds the media one sheet by one sheet, which is contained in the medium container, a detection part that detects a remaining amount of the media contained in the medium container, and a searching part that searches for another medium container that contains media that is the same as the media contained in the medium container. The sheet feeding controller, when the detection part detects that the remaining amount of the media contained in the medium container has reached a predetermined amount, feeds one of the media, which is contained in the another medium container that is found by the searching part, to a predetermined position.

According to the present invention, an effect is obtained that reduction in the processing capability can be suppressed even when the number of sheets of the remaining medium has reached a predetermined amount.

BRIEF DESCRIPTION OF DRAWINGS

FIG. 1 illustrates a block diagram illustrating a configuration of an image forming apparatus of an embodiment.

FIG. 6 illustrates a flow diagram illustrating flow of a sheet feeding process of the embodiment.

DETAILED EMBODIMENTS

In the following, with reference to the drawings, an embodiment of an image forming apparatus according to the present invention is described.

First Embodiment

Figure 2:
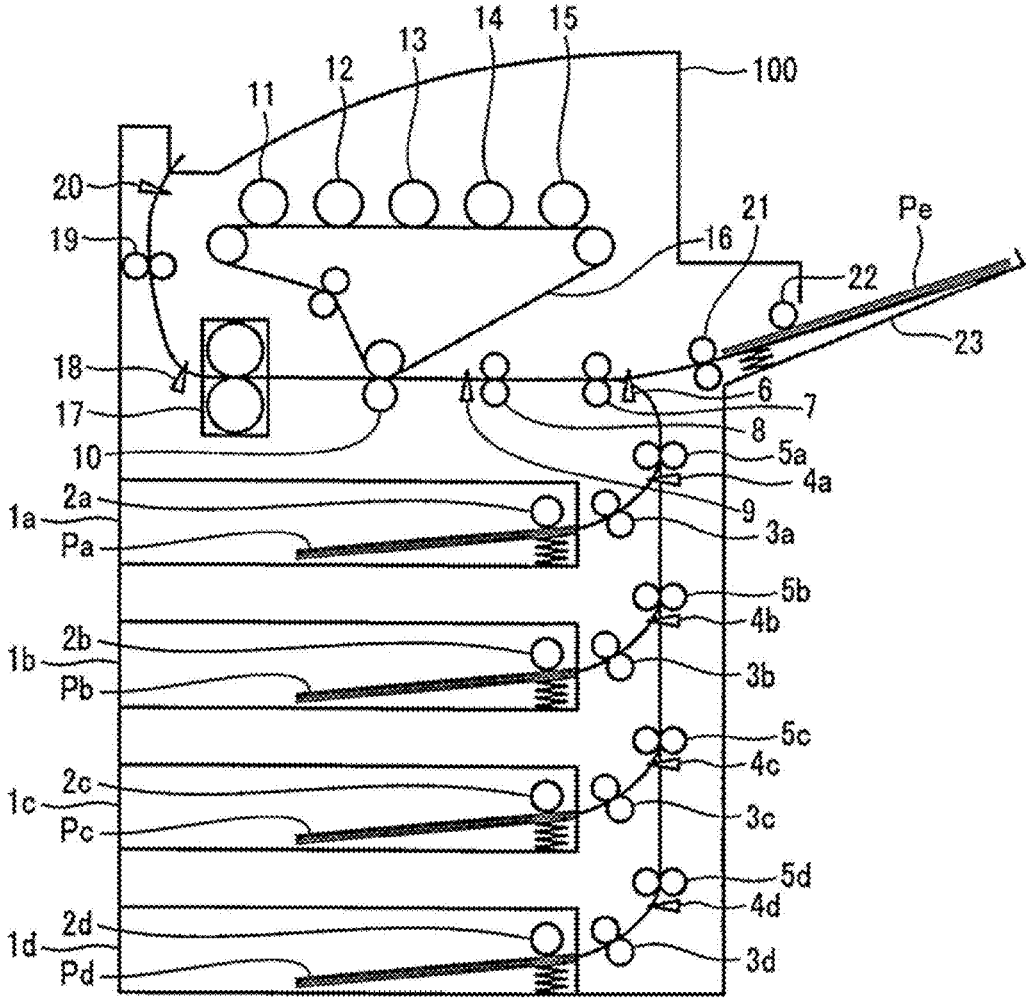
FIG. 2 illustrates a schematic side cross-sectional view illustrating the configuration of the image forming apparatus of the embodiment.

FIG. 2 illustrates a schematic side cross-sectional view illustrating a configuration of an image forming apparatus of an embodiment. In FIG. 2, an image forming apparatus 100 is, for example, a printer, and is configured by a plurality of sheet feeding trays 1 (1*a*, 1*b*, 1*c*, 1*d*) that contain print sheets (hereinafter, referred to as "sheets") P (Pa, Pb, Pc, Pd) as media, sheet feeding rollers 2 (2*a*, 2*b*, 2*c*, 2*d*) that feed the sheets, sheet separation rollers 3 (3*a*, 3*b*, 3*c*, 3*d*) that separate the sheets one by one, first entrance sensors 4 (4*a*, 4*b*, 4*c*, 4*d*) that detect the sheets, first registration roller pairs 5 (5*a*, 5*b*, 5*c*, 5*d*), a second entrance sensor 6, a second registration roller pair 7, an adjustment roller 8, a writing sensor 9, a secondary transfer roller 10 as a transfer part, image drums 11, 12, 13, 14, 15 as image carriers, an image carrying belt 16 as an intermediate transfer body, a fuser 17, a first exit sensor 18, an ejection roller 19, a second exit sensor 20, a multipurpose tray (hereinafter, referred to as "MPT") sheet separation roller 21, an MPT sheet feeding roller 22, and an MPT sheet feeding tray 23.

In the first embodiment, four trays are installed. They are referred with, from the top to the bottom, references 1*a* to 1*d*. The suffix "a" to "d" in FIG. 2 are used in correspondence with the trays for other components. For example, sheet feeding roller 2*c* means a roller arranged for the sheet feeding tray 1*c*. The registration roller pair 5*d* means a roller pair arranged for the sheet feeding tray 1*d*.

The above components configure a image forming section where an image forming process is performed. When a sheet on a sheet carrying path reaches the secondary transfer roller 10, it means that sheet is delivered to the image forming section.

The sheet feeding trays 1 (1*a*, 1*b*, 1*c*, 1*d*) as medium containers respectively include the sheet feeding rollers 2 (2*a*, 2*b*, 2*c*, 2*d*), the sheet separation rollers 3 (3*a*, 3*b*, 3*c*, 3*d*), the first entrance sensors 4 (4*a*, 4*b*, 4*c*, 4*d*) and the first registration roller pairs 5 (5*a*, 5*b*, 5*c*, 5*d*), and have the same configuration.

The first entrance sensor 4*a* is arranged at a sheet carrying path that is ranged from the sheet separation roller 3*a* to the first registration roller pair 5*a*, also at another sheet carrying path that is ranged from the first registration roller pair 5*b* to the first registration roller pair 5*a*. In short, the first entrance sensor 4*a* is defined as being arranged at a merge point between the sheet carrying path along which a sheet delivered from the sheet separation roller 3*a* runs and the another sheet carrying path along which another sheet delivered from the first registration roller 5*b* runs. Thereby, the first entrance sensor 4*a* is able to sense either sheet that is carried by the sheet separation roller 3*a* or that is carried by the first registration roller pair 5*b*.

The first entrance sensor 4*b* is arranged at a sheet carrying path that is ranged from the sheet separation roller 3*b* to the first registration roller pair 5*b*, also at another sheet carrying path that is ranged from the first registration roller pair 5*c* to the first registration roller pair 5*b*. In short, the first entrance sensor 4*b* is defined as being arranged at a merge point between the sheet carrying path along which a sheet delivered from the sheet separation roller 3*b* runs and the another sheet carrying path along which another sheet delivered from the first registration roller 5*c* runs. Thereby, the first entrance sensor 4*b* is able to sense either sheet that is carried by the sheet separation roller 3*b* or that is carried by the first registration roller pair 5*c*.

The first entrance sensor 4*c* is arranged at a sheet carrying path that is ranged from the sheet separation roller 3*c* to the first registration roller pair 5*c*, also at another sheet carrying path that is ranged from the first registration roller pair 5*d* to the first registration roller pair 5*c*. In short, the first entrance sensor 4*c* is defined as being arranged at a merge point between the sheet carrying path along which a sheet delivered from the sheet separation roller 3*c* runs and the another sheet carrying path along which another sheet delivered from the first registration roller 5*d* runs. Thereby, the first entrance sensor 4*c* is able to sense either sheet that is carried by the sheet separation roller 3*c* or that is carried by the first registration roller pair 5*d*.

The first entrance sensor 4*d* is arranged at a sheet carrying path that is ranged from the sheet separation roller 3*d* to the first registration roller pair 5*d*. In short, the first entrance sensor 4*d* is able to sense a sheet that is carried by the sheet separation roller 3*d*.

Figure 3:
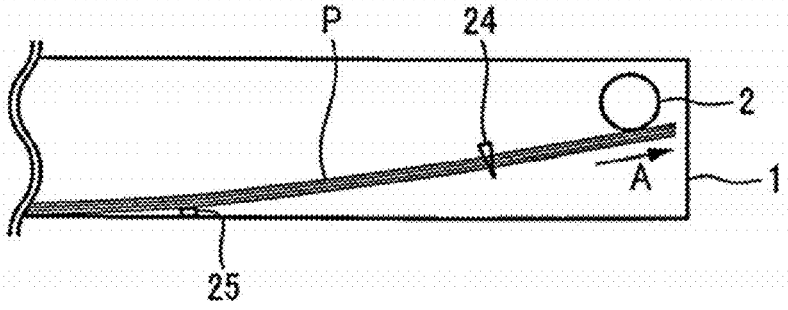
FIG. 3 illustrates an explanatory diagram illustrating a configuration of a sheet feeding tray of the embodiment.

FIG. 3 illustrates an explanatory diagram illustrating the configuration of the sheet feeding tray of the embodiment. In FIG. 3, the sheet feeding tray 1 is configured by the sheet feeding roller 2, a no-sheet detection sensor 24 as a detection part for detecting that there is no remaining sheet, and a remaining-sheet detection sensor 25 as a detection part for detecting a remaining sheet amount. By rotating the sheet feeding roller 2, the sheet P that is contained in the sheet feeding tray 1 is fed in a sheet feeding direction indicated by an arrow A in FIG. 3.

For a detection part of remaining sheets, various configurations are conceivable. For example, the remaining-sheet detection sensor 25 may be a sensor that performs detection of remaining sheets by detecting a weight of sheets that are loaded using a pressure sensor, a sensor that performs detection of remaining sheets using a bottom plate detection sensor that detects a position of a bottom plate, a sensor that performs detection of remaining sheets based on intensity of transmitted light using a light emitting element and a light receiving element that are provided in a manner sandwiching the sheets that are loaded, a sensor that performs detection of remaining sheets using a sheet thickness sensor to detect a sheet thickness of the sheets that are loaded, and the like. In the present embodiment, the remaining sheet detection part that is used is not particularly limited. Any remaining sheet detection part may be adopted. In this way, the no-sheet detection sensor 24 and the remaining-sheet detection sensor 25 configure a detection part that detects a remaining amount of sheets that are contained in the sheet feeding tray 1.

FIG. 1 illustrates a block diagram illustrating the configuration of the image forming apparatus of the embodiment. In FIG. 1, the image forming apparatus 100 is configured by a system controller 101, a connection I/F part 102, an operation display part 103, an image formation controller 104, a fuser controller 105, a sheet feeding controller 106, a carrying controller 107 and a print controller 108. The system controller 101 is a control part that is configured by a CPU and the like, and controls an overall operation of the image forming apparatus 100 based on a control program (software) that is stored in a storage part such as a memory. The system controller 101 receives a notification of a reception result of a command as an instruction received by the connection I/F part 102, starts the operation display part 103, the print controller 108 and the like, and executes processing. Further, the system controller 101 notifies the image formation controller 104 of print data received by the connection I/F part 102.

The connection I/F part 102 performs communication connection with a LAN (Local Area Network) line as a communication line and performs TCP/IP (Transmission Control Protocol/Internet Protocol) control and the like. The connection I/F part 102 performs transmission and reception of information such as a command and print data to and from a host device that is communicably connected via a LAN line. The operation display part 103 performs display of information in a display part such as a display and receives an operation of an operator using an input part such as a touch panel and operation keys.

The image formation controller 104 stores print data that is received by the connection I/F part 102 in a memory such as a hard disk, develops developer images on the image drums 11-15 illustrated in FIG. 2 based on the print data, and forms an image on the image carrying belt 16. The fuser controller 105 controls the fuser 17 illustrated in FIG. 2 and fuses a developer image that is transferred to a sheet. The sheet feeding controller 106 performs control to feed the media contained in the sheet feeding trays 1, controls the sheet feeding rollers 2, the MPT sheet feeding roller 22, the sheet separation rollers 3 and the MPT sheet separation roller 21 that are illustrated in FIG. 2, and feeds the sheets P that are contained in the sheet feeding trays 1 and the MPT sheet feeding tray 23.

The carrying controller 107 carries a sheet that is fed by the sheet feeding controller 106, controls the first registration roller pairs 5, the second registration roller pair 7, the adjustment roller 8, the secondary transfer roller 10, the image carrying belt 16 and the ejection roller 19 that are illustrated in FIG. 2, and carries the sheets P. The print controller 108 controls a print operation, starts the sheet feeding controller 106 and the carrying controller 107 to perform feeding and carrying of a sheet, performs formation of an image and carrying of the formed image via the image formation controller 104, transfers an image on the image carrying belt 16 illustrated in FIG. 2 to a carried sheet, and fuses the image on the sheet via the fuser controller 105.

The sheet feeding controller 106 is configured by a remaining print sheet number detector 106*a*, a tray searching part 106*b* and a sheet feeding operation controller 106*c*. The remaining print sheet number detector 106*a* detects, via the remaining-sheet detection sensor 25 illustrated in FIG. 3, a number of sheets of a predetermined amount that are contained in the sheet feeding tray 1. The tray searching part 106*b* as a searching part searches for substitute sheet feeding tray that contains another medium that is the same as a medium contained in the sheet feeding tray that is being used in printing, and, when it is detected by the remaining print sheet number detector 106*a* that the number of sheets is equal to or less than the predetermined amount in continuous printing, searches for substitute sheet feeding tray that contains sheets the same as sheets contained in the sheet feeding tray that is being used in printing. The sheets fed from the substitute tray may be referred as substitute sheets (or substitute media).

The sheet feeding operation controller 106*c* controls an operation in which a sheet contained in a sheet feeding tray is fed, and controls an operation when s sheet is fed from substitute sheet feeding tray that is found by the tray searching part 106*b*. The sheet feeding controller 106 that is configured as described above feeds a medium that is contained in another medium container that is found by the tray searching part 106*b* to a predetermined position when it is detected by the remaining print sheet number detector 106*a* that a remaining amount of a medium that is contained in the sheet feeding tray 1 has reached an amount equal to or less than the predetermined amount. The carrying controller 107 is configured by a re-carrying timing generation part 107*a*, a re-carrying instructing part 107*b* and a carrying operation controller 107*c*.

The re-carrying timing generation part 107*a* as a timing generation part generates a subsequent medium carrying timing so that a medium interval (or sheet interval in the embodiment) that is defined as between a final sheet contained in a sheet feeding tray and a subsequent sheet that has been fed to a predetermined position is the same as a normal medium interval in continuous printing. The medium interval is 7 cm in the embodiment. When it is detected by the no-sheet detection sensor 24 illustrated in FIG. 3 that there is no sheet in a sheet feeding tray that is being used in continuous printing, the re-carrying timing generation part 107*a* generates a timing for re-carrying a sheet that was fed by the sheet feeding operation controller 106*c*.

Figure 10:
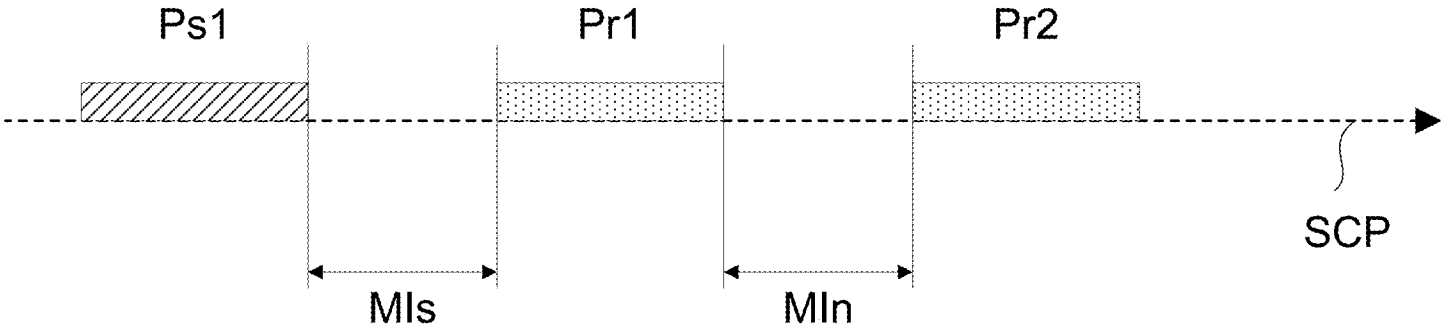
FIG. 10 illustrates medium intervals that are interval between sheets fed from an original and substitute sheet trays.

FIG. 10 illustrates these medium intervals discussed above. The dotted arrow means an imaginary sheet carrying path SCP. Along the path, sheet Pr2, sheet Pr1 and sheet Ps1 are carried. Sheet Pr1 means a final sheet that is carried from the original sheet tray for the print process. Sheet Pr2 means a second final original sheet that is carried just before the final original sheet. Sheet Ps1 means a first substitute sheet that is fed from the substitute sheet tray. As shown in the figure, the normal medium interval MIn may be measured from the rear edge of the second final original sheet Pr2 to the front edge of the final original sheet Pr1. The substitute medium interval MIs may be measured from the rear edge of the final original sheet Pr1 to the front edge of the first substitute sheet Ps1. During a print process for original sheets, the normal medium interval can be measured anytime by observing a distance or time difference between one original sheet that is fed first and the next original sheet that is fed following. However, it is a convenient way to measure the final two sheets fed from the original sheet tray.

The re-carrying instructing part 107*b*, based on the timing generated by the re-carrying timing generation part 107*a*, instructs the carrying operation controller 107*c* to re-carry the sheet that is fed by the sheet feeding operation controller 106*c*. The carrying operation controller 107*c* performs control to carry a sheet by the first registration roller pairs 5, the second registration roller pair 7, the adjustment roller 8, the secondary transfer roller 10, the image carrying belt 16 and the ejection roller 19 that are illustrated in FIG. 2. The carrying operation controller 107*c* receives an instruction from the re-carrying instructing part 107*b* and starts re-carrying of the sheet that is fed.

The carrying controller 107 that is configured as described above, when the no-sheet detection sensor 24 as a detection part illustrated in FIG. 3 detects that a medium contained in the sheet feeding tray that is being used in printing is used up, carries respective media by making a medium interval between a final medium contained in the sheet feeding tray that is being used in printing and a subsequent medium that has been fed to the predetermined position by the sheet feeding controller 106 to be the same as a normal medium interval in continuous printing based on a timing generated by the re-carrying timing generation part 107*a*.

The print controller 108 performs printing, based on a number of sheets of a medium fed from substitute sheet feeding tray and a number of remaining images of print data, on a medium that is fed to a predetermined position by the sheet feeding controller 106, and is configured by a remaining image managing part 108*a*, a feeding sheet managing part 108*b* and a tray switching controller 108*c*. The remaining image managing part 108*a* counts as a number of remaining images a number of unprinted images in received print data and a number of images that are primarily transferred onto the image carrying belt 16 illustrated in FIG. 2, and manages the number of the remaining images.

The feeding sheet managing part 108*b* counts a number of sheets for which sheet-feeding by the sheet feeding operation controller 106*c* has completed and onto which images that have been primarily transferred to the image carrying belt 16 illustrated in FIG. 2 have not been secondarily transferred, and manages the number of the sheets. The tray switching controller 108*c* performs control to switch from a sheet feeding tray that feeds a sheet to a sheet feeding tray that is found by the tray searching part 106*b*. The print controller 108 that is configured as described above, before a medium contained in a sheet feeding tray is used up, performs printing using a medium that is fed to a predetermined position when it is judged that remaining images of print data can be printed using a medium fed from substitute sheet feeding tray based on the number of the remaining images that is managed by the remaining image managing part 108*a* and the number of sheets that is managed by the feeding sheet managing part 108*b*.

An operation of the above-described configuration is described. A print process and a sheet carrying process that the image forming apparatus performs are described following steps that are indicated using S in the flow diagram of FIG. 4 that illustrates flow of the print process of the embodiment and in the flow diagram of FIG. 5 that illustrates flow of the sheet carrying process of the embodiment, with reference to FIGS. 1 and 2. S11 of FIG. 4 and S21 of FIG. 5: The connection I/F part 102 of the image forming apparatus 100 receives command data from a host device that is connected to the LAN line, performs analysis of the received command data, and, when it is judged that the command data is a print request, notifies the system controller 101 of the receipt of the print request command data (hereinafter, referred to as "print data"). (Print Data Reception)

The system controller 101 that has received the notification generates print data based on print information specified in a header portion of the print request command, and instructs the print controller 108 to start printing. S22 of FIG. 5: The print controller 108 that has received the instruction to start printing instructs the sheet feeding controller 106 to start feeding a sheet. (Start Sheet Feeding) S12 of FIG. 4: Further, the print controller 108 instructs the image formation controller 104 to start formation of an image, and the image formation controller 104 starts an image formation process that outputs an image based on the print data.

Figure 4:
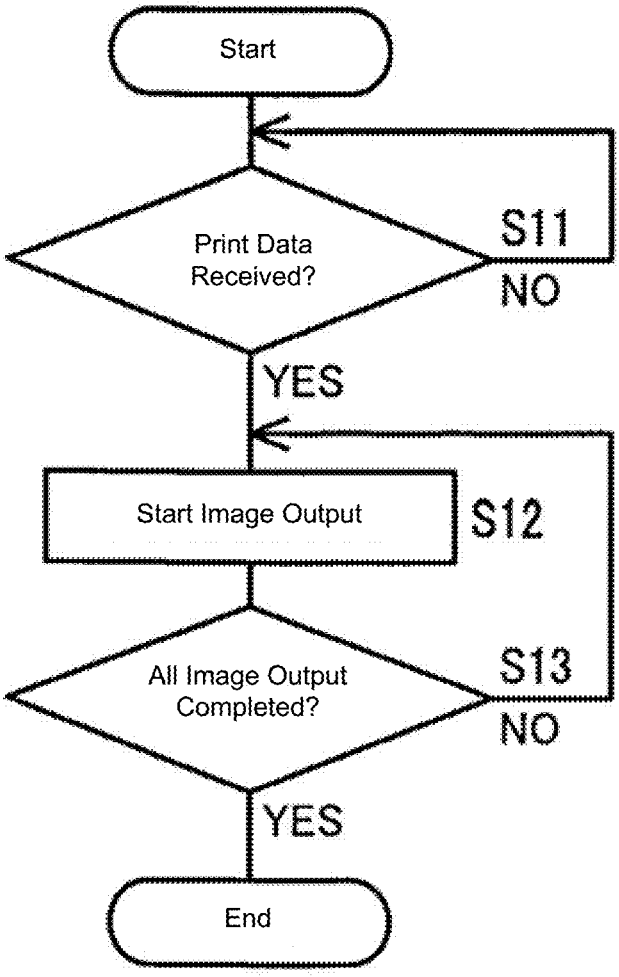
FIG. 4 illustrates a flow diagram illustrating flow of a print process of the embodiment.

S13 of FIG. 4: The image formation controller 104 judges whether or not output of all images of the print data has completed. When it is judged that the output of all images of the print data has not completed, the image formation controller 104 causes the processing to proceed to S12 to perform the image formation process. When it is judged that the output of all images of the print data has completed, the image formation controller 104 terminates the image formation process and terminates the present processing. Continuation of S22 of FIG. 5: The sheet feeding controller 106 that has received the instruction to start feeding a sheet feeds a sheet contained in the sheet feeding tray 1. Details of the sheet feeding operation will be described later. S23 of FIG. 5: When the sheet feeding operation by the sheet feeding controller 106 has completed, the carrying controller 107 carries the sheet that is fed using the respective rollers. (Start Carrying)

Figure 5:
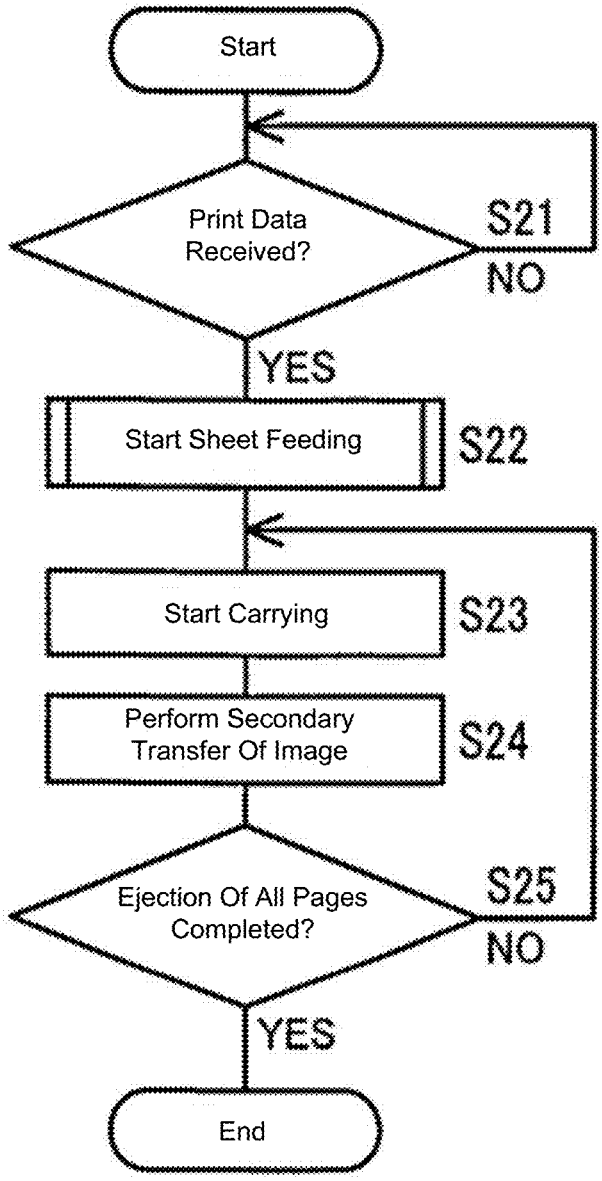
FIG. 5 illustrates a flow diagram illustrating flow of a sheet carrying process of the embodiment.

S24 of FIG. 5: When a leading edge of the sheet that is carried by the carrying controller 107 reaches the secondary transfer roller 10, the print controller 108 secondarily transfers an image that has been primarily transferred to the image carrying belt 16 to the sheet. (Perform Secondary Transfer of Image) S25 of FIG. 5: The system controller 101 judges whether or not all sheets onto which the images based on the print data are secondarily transferred are ejected from the image forming apparatus 100 by the carrying controller 107 and all printing based on the print data has completed. When it is judged that printing has not all completed, the processing proceeds to S23 to perform subsequent carrying of a sheet and secondary transfer of an image. When it is judged that all printing has completed, the present processing is terminated.

Next, the sheet feeding process that the image forming apparatus performs is described following steps that are indicated using S in the flow diagram of FIG. 6 that illustrates flow of the sheet feeding process of the embodiment, with reference to FIGS. 1-3. S31: The sheet feeding controller 106 that has received a sheet feeding instruction from the print controller 108 instructs the sheet feeding operation controller 106*c* to start sheet feeding. The sheet feeding operation controller 106*c* that has received an instruction to start sheet feeding causes the sheet feeding rollers 2 to rotate and performs feeding of a sheet contained in the sheet feeding trays 1. (Sheet Feeding Starts)

Figure 7:
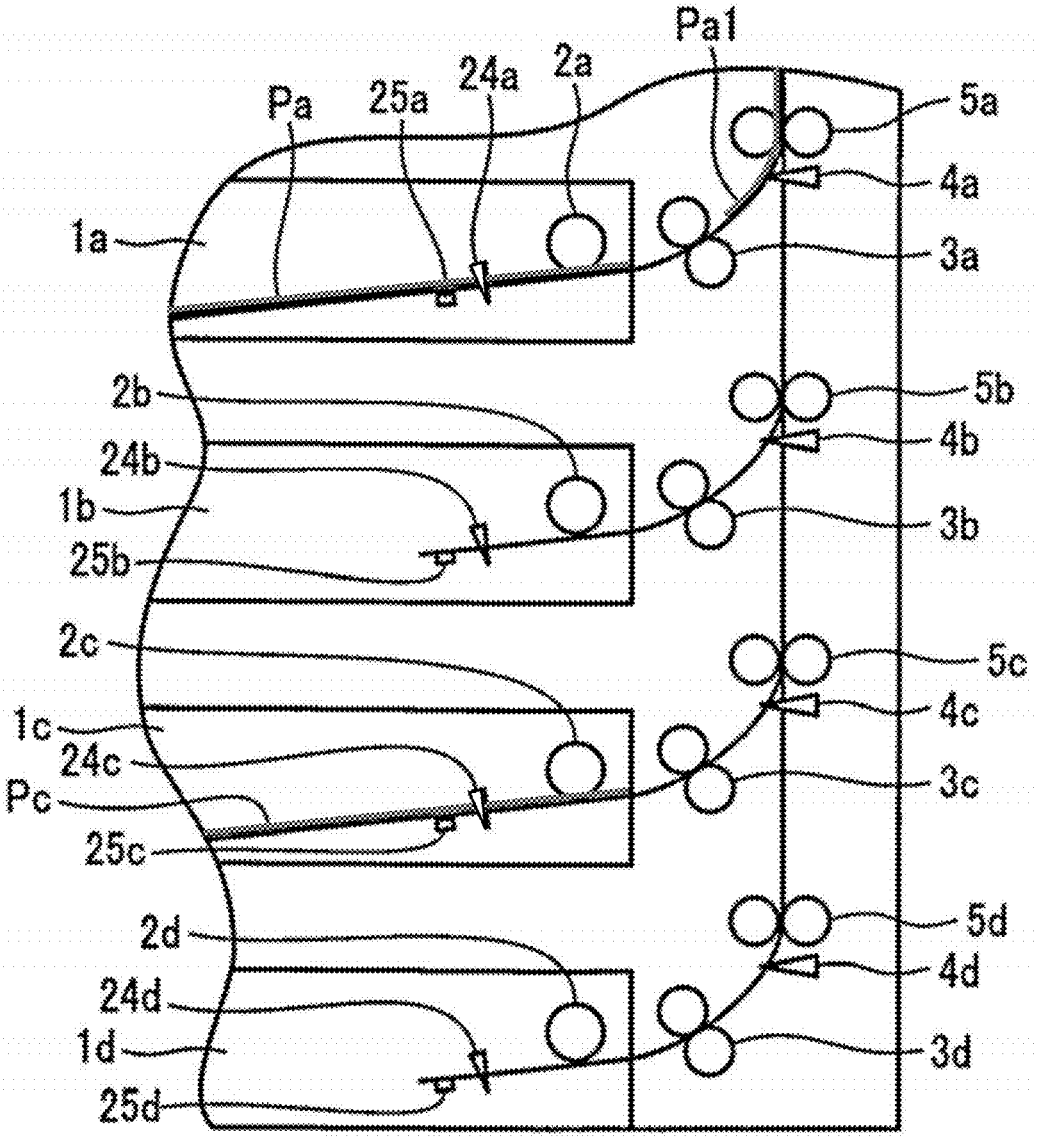
FIG. 7 illustrates an explanatory diagram for a sheet feeding operation of the embodiment.

For example, as illustrated in FIG. 7, a plurality of sheets Pa that are contained in the sheet feeding tray 1*a* are separately fed sheet by sheet by the topmost sheet being supplied by the sheet separation roller 3*a* due to the rotation of the sheet feeding roller 2*a*. The first entrance sensor 4*a* is turned on (sheet detection) by a fed sheet Pa1. After a leading edge of the sheet Pa1 butts against the first registration roller pair 5*a* and a skew of the sheet Pa1 is eliminated, the sheet Pa1 passes through the second registration roller pair 7 and the adjustment roller 8, and is carried to the secondary transfer roller 10. Here, a sheet fed from the sheet feeding tray 1*a* is the sheet Pa1. Control of activation timing of the rollers such as the first registration roller pair 5*a*, the second registration roller pair 7 and the adjustment roller 8, control of position adjustment of a leading edge image and a sheet leading edge, control of transfer and fusion of an image, and the like, are performed by the print controller 108 through the system controller 101 using known control technologies and thus description thereof is omitted.

The reference Pa means a general term indication who sheets contained in the tray 1*a*. On the other hand, references Pa1, Pa2, Pa3 indicate sequential individual sheets supplied from the tray 1*a* first, second and third. References Pc1, Pc2, Pc3, or Pd1, Pd2, Pd3 as well are used under the same rule as the reference Pa.

S32: The sheet feeding operation controller 106*c* that has completed feeding of a sheet Pa1 judges whether or not there is a next-page sheet to be fed, that is, whether or not there is a next-page sheet feeding request. When it is judged that there is not a next-page sheet feeding request, the sheet feeding operation controller 106*c* notifies the sheet feeding controller 106 of completion of a sheet feeding operation and terminates the sheet feeding operation to terminate the present processing. The sheet feeding operation controller 106*c* that has judged that there is a next-page sheet feeding request generates a sheet feeding timing of a next-page sheet Pa based on timings of ON (sheet detection) or OFF (non-sheet detection) of the first entrance sensor 4 and the second entrance sensor 6 of a preceding sheet Pa.

S33: The remaining print sheet number detector 106*a* judges, using the remaining sheet sensor 25, whether or not the number of the sheets contained in the sheet feeding tray 1*a* is equal to or less than a predetermined amount. For example, after the sheet Pa1 illustrated in FIG. 7 is carried, when the number of the sheets that are loaded and contained in the sheet feeding tray 1*a* becomes small, in a case where the remaining sheet sensor 25*a* is a pressure sensor, the remaining print sheet number detector 106*a* detects that a weight of the loaded sheets becomes equal to or less than a predetermined weight and detects that the number of the sheets has become equal to or less than a predetermined amount. When it is judged that the number of the sheets contained in the sheet feeding tray 1*a* is equal to or less than the predetermined amount, the remaining print sheet number detector 106*a* causes the processing to proceed to S34. When it is judged that the number of the sheets, which are multiple, contained in the sheet feeding tray 1*a* is not equal to or less than the predetermined amount, the remaining print sheet number detector 106*a* causes the processing to proceed to S31 to continue to feed a sheet Pa contained in the sheet feeding tray 1*a*.

S34: When the remaining print sheet number detector 106*a* judges that the number of sheets contained in the sheet feeding tray 1*a* is equal to or less than the predetermined amount, the tray switching controller 108*c* judges whether or not it is necessary to switch from the sheet feeding tray 1*a* to substitute sheet feeding tray 1 to feed a sheet. Here, the tray switching controller 108*c* queries the remaining image managing part 108*a* and the feeding sheet managing part 108*b*, and judges that sheet feeding from substitute sheet feeding tray 1 is necessary when the number of remaining images of the print data and images for which primary transfer output to the image carrying belt 16 has been performed is larger than the number of remaining sheets contained in the sheet feeding tray 1*a* and sheets before image transfer (secondary transfer).

In a case where a sum of the number of remaining images of the print data and the number of images for which primary transfer output to the image carrying belt 16 has been performed is 8 and a sum of the number of the remaining sheets contained in the sheet feeding tray 1*a* and the number of the sheets before image transfer (secondary transfer) is 2, since there are less sheets, it is judged that sheet feeding from substitute sheet feeding tray 1 is necessary. The tray switching controller 108*c* causes the processing to proceed to S35 in order to switch to substitute sheet feeding tray 1 when it is judged that it is necessary to switch from the sheet feeding tray 1*a* to substitute sheet feeding tray 1 to feed a sheet, and causes the processing to proceed to S31 to continue sheet feeding from the sheet feeding tray 1*a* when it is judged that it is not necessary to switch from the sheet feeding tray 1*a* to substitute sheet feeding tray 1.

S35: When the tray switching controller 108*c* judges that it is necessary to switch from the sheet feeding tray 1*a* to substitute sheet feeding tray (1*b*, 1*c* or 1*d*) to feed a sheet, the tray searching part 106*b* searches for substitute sheet feeding tray 1 that contains the same medium as the sheets contained in the sheet feeding tray 1*a* that is feeding a sheet. When it is judged that there is substitute sheet feeding tray 1 that contains the same medium, the processing proceeds to S36. When it is judged that there is no other sheet feeding tray 1 that contains the same medium, similar to a conventional image forming apparatus, by performing sheet feeding control and print control by increasing the inter-sheet distance, waste of toner and reduction in productivity are prevented, and the present processing is terminated.

Here, when there is substitute sheet feeding tray 1 that contains the same medium, for example, as illustrated in Table 1, when a sheet Pa contained in the sheet feeding tray 1*a* has a sheet size of "A4 lateral" and a sheet thickness of "thin" and a sheet Pc contained in the sheet feeding tray 1*c* has a sheet size of "A4 lateral" and a sheet thickness of "thin," the tray searching part 106*b* sets the substitute sheet feeding tray 1 to be the sheet feeding tray 1*c*.

TABLE 1

| | Sheet Size | Sheet Thickness |
|---|---|---|
| Sheet Feeding Tray 1a (Pa) | A4 Lateral | Thin |
| Sheet Feeding Tray 1c (Pc) | A4 Lateral | Thin |

S36: The sheet feeding controller 106 instructs the sheet feeding operation controller 106*c* to start sheet feeding using the set substitute sheet feeding tray 1 (for example, the sheet feeding tray 1*c*). The sheet feeding operation controller 106*c* that has received an instruction to start sheet feeding causes the sheet feeding rollers 2 of the set substitute sheet feeding tray 1 to rotate and performs feeding of sheets contained in the substitute sheet feeding trays 1.

Figure 8B:
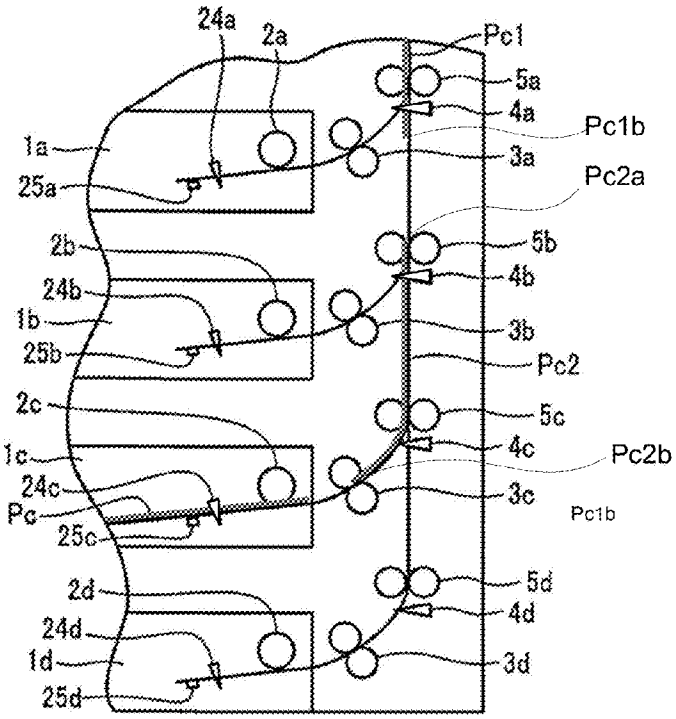
FIGS. 8A and 8B illustrate explanatory diagrams for a sheet feeding operation of the embodiment.
Figure 8A:
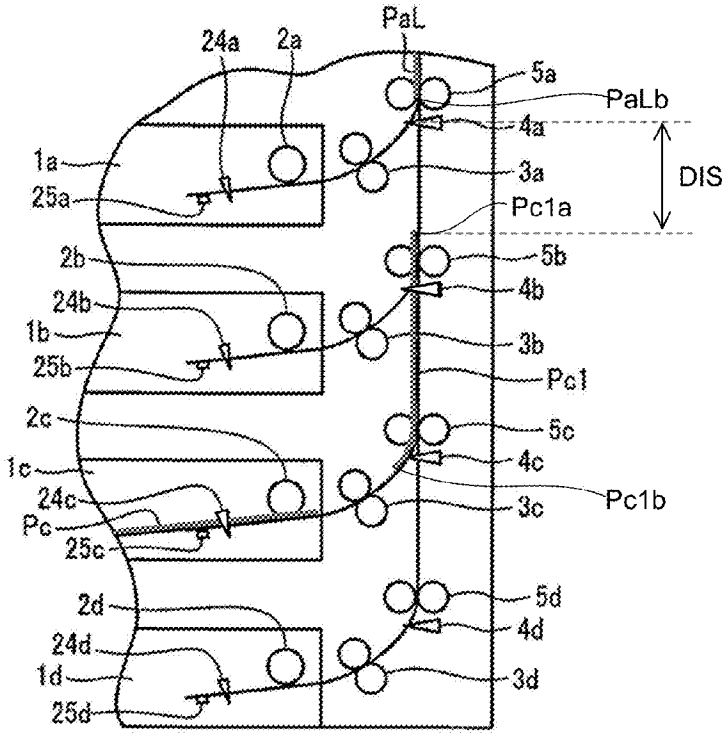

As illustrated in FIG. 8A, the sheet feeding operation controller 106*c* causes the sheet feeding roller 2*c* to rotate to separately feed sheets Pc, which are multiple, contained in the sheet feeding tray 1*c*, sheet by sheet by the topmost sheet being supplied by the sheet separation roller 3*c*, activates the first registration roller pairs 5*b*, 5*c* and carries a leading edge Pc1*a* of the sheet Pc1, which is carried by the sheet supply roller 2*c*, to a predetermined position. Following the operation, a trailing edge Pc1*b* of the sheet Pc1 moves. Here, in a case where the continuous sheet supply is made by the sheet supply tray 1*a*, the predetermined position is a position that allows the sheet Pc1 to be carried at a normal inter-sheet distance in continuous printing when the sheet Pc1 is carried following after the trailing edge PaLb of the sheet PaL that is fed from the sheet feeding tray 1*a*. For example, in a case of control in which inter-sheet distance (or medium interval) is generated by turning off the first entrance sensor 4*c* and the like, the predetermined position is a position such that the inter-sheet distance is smaller than the normal inter-sheet distance from the Off of the first entrance sensor 4*c*.

More specifically, in a case where a sheet supply tray that supplies a sheet and conducts a print operation is the sheet supply tray 1*a*, the leading edge Pc1*a* of the sheet Pc1, which is supplied from the sheet supply tray 1*c* arranged at a lower level from the sheet supply tray 1*a* and at an upstream side in the sheet carrying direction, is carried at a downstream side in the sheet carrying direction from the first entrance sensor 4*a*, and stopped after carried up to a predetermined position. The predetermined position is less far from the first entrance sensor 4*a* at the upstream side in the sheet carrying direction than the medium interval. In the embodiment, the medium interval is 7 cm, the predetermined position is determined at 3 cm away from the first entrance sensor 4*c* at the upstream side in the sheet carrying direction. When a no-sheet detection sensor 24*a* detects an empty of the sheet supply tray 1*a* due to the trailing edge Pa1*b* of the sheet Pa1, which is the final sheet in the tray, passing by the sensor 24*a*, a sheet carrying operation of the sheet Pc1, which has been suspended, is resumed before the trailing edge Pa1*b* of the sheet Pa1 carried from the sheet supply tray 1*a* passes the first entrance sensor 4*a* more than 4 cm since the sensor detects the passing of the sheet Pa1. Also, the carrying speed is adjusted in order to coordinate the medium interval at the same time.

As described above, in the present embodiment, when a sheet carrying path between the substitute sheet feeding tray and the original sheet feeding tray is sufficiently long, a plurality of sheets can stay in the sheet carrying path.

Corresponding to the original sheet feeding tray, the another tray may be referred as a substitute sheet feeding tray.

S37: After feeding a sheet from the substitute sheet feeding tray 1*c* (or another tray from the original tray 1*a*) and carrying the sheet to the predetermined position, the sheet feeding operation controller 106*c* starts sheet feeding from the original sheet feeding tray 1*a* in continuous printing. S38: The remaining print sheet number detector 106*a* uses the no-sheet detection sensor 24*a* to judge a no-sheet state of the original sheet feeding tray 1*a* in continuous printing. When the no-sheet state is detected, the remaining print sheet number detector 106*a* notifies the re-carrying timing generation part 107*a* of the no-sheet state and causes the processing to proceed to S39. When the non-sheet state is not detected, the processing proceeds to S42.

S39: The re-carrying timing generation part 107*a* that has received a no-sheet notification uses a final sheet of the sheet feeding tray that is being used in continuous printing and detects a trailing edge of the final sheet using a sensor provided in the sheet carrying path, and generates a re-carrying timing of the sheet that has been fed from the substitute sheet feeding tray to the predetermined position. For example, as illustrated in FIG. 8A, based on a timing when the trailing edge PaLb of a final sheet PaL that is fed from the sheet feeding tray 1*a* is detected by the entrance sensor 4*a* (detection of Off of the entrance sensor 4*a*), the re-carrying timing generation part 107*a* generates a re-carrying timing that is a waiting time period for starting re-carrying of the print sheet Pc1 that is fed from the sheet feeding tray 1*c* as the substitute sheet feeding tray. For example, in a case where the leading edge of Pc1*b* of the sheet Pc1 is waiting (or held) at the predetermined position that is at the upstream side in the sheet carrying direction from the first entrance sensor 4*a* of the sheet supply tray 4*a*. The predetermined position is with a predetermined distance away from the first entrance sensor 4*a* at the upstream side in the sheet carrying direction and less far from the medium interval. In the embodiment, since the medium interval is 7 cm, the predetermined distance is 3 cm that is 50% or less that the medium interval. The distance is referred with DIS in FIG. 8A. When the no-sheet detection sensor 24*a* detects an empty of the sheet supply tray 1*a* due to the trailing edge Pa1*b* of the sheet Pa1 passing by the sensor 24*a*, a sheet carrying operation of the sheet Pc1, which has been suspended, is resumed at a timing. The timing is determined to be a required time for which the trailing edge Pa1*b* of the sheet Pa1 moves 4 cm since the first entrance sensor 4*a* detects the sheet Pc1 passing through the sensor. The moving distance, 4 cm, is calculated based on the carrying distance per unit time or the rotation speed of the registration roller pair 5*a*.

S40: When a time period corresponding to the re-carrying timing that is generated by the re-carrying timing generation part 107*a* has passed, the re-carrying instructing part 107*b* notifies the sheet feeding operation controller 106*c* of a re-carrying instruction with respect to a sheet that is fed from the substitute sheet feeding tray to a predetermined position. For example, at S39, when a time period corresponding to the re-carrying timing that is generated by the re-carrying timing generation part 107*a* has passed, the re-carrying instructing part 107*b* notifies the sheet feeding operation controller 106*c* of the re-carrying instruction with respect to the sheet Pc1 that is fed from the sheet feeding tray 1*c* to the predetermined position. The sheet feeding operation controller 106*c* that has received the instruction, as illustrated in FIG. 8B, activates the first registration roller pairs 5*b*, 5*c* to perform re-carrying of the sheet Pc1. In this case, the sheet feeding controller 106 switches the sheet feeding tray that is being used in continuous printing from the sheet feeding tray 1*a* to the sheet feeding tray 1*c*.

S41: The sheet feeding controller 106 that has switched the sheet feeding tray that is being used in continuous printing judges whether or not there is a next-page sheet feeding request. When it is judged that there is a sheet feeding request, the sheet feeding controller 106 causes the processing to proceed to S31 and performs sheet feeding via the sheet feeding operation controller 106*c*. When it is judged that there is not a sheet feeding request, the sheet feeding controller 106 terminates the present processing. For example, as illustrated in FIG. 8B, the sheet feeding operation controller 106*c* that has judged that there is a sheet feeding request, after started re-carrying of the sheet Pc1, starts feeding of a sheet Pc2. By supplying the sheet Pc2, the leading edge Pc1*a* and the trailing edge Pc1*b* move. The carrying speed for the sheets are controlled in a manner that the trailing edge Pc1*b* of the sheet Pc1 and the leading edge Pc2*a* of the sheet Pc2 maintain a predetermined distance therebetween, which is the normal medium interval 7 cm. Thereafter, repeatedly performs sheet feeding until printing terminates. S42: On the other hand, in a case where, at S38, a no-sheet state of the original sheet feeding tray 1*a* in continuous printing was not detected by the sheet feeding operation controller 106*c*, the print controller 108 compares the number of remaining images that is managed by the remaining image managing part 108*a* and the number of fed sheets that is managed by the feeding sheet managing part 108*b* and judges whether or not the number of remaining images and the number of fed sheets match. When it is judged that the number of remaining images and the number of fed sheets match, the processing proceeds to S39 to perform re-carrying of the sheets. When it is judged that the number of remaining images and the number of fed sheets do not match, the processing proceeds to S37.

Figure 9A:
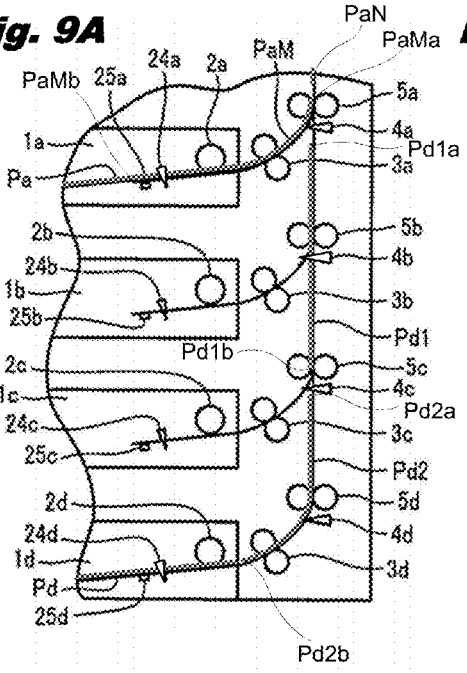
FIGS. 9A-9C illustrate explanatory diagrams for a sheet feeding operation of the embodiment.

Another embodiment is described hereinafter. As illustrated in FIG. 9A, the embodiment has a long sheet carrying path that is more than a combined length that is a sheet length from a leading edge to a trailing edge and the predetermined medium interval, 7 cm. In the embodiment, a sheet Pd1 and a sheet Pd2 are supplied within the sheet carrying path, the leading edge Pd1*a* of the sheet Pd1 is stopped at a predetermined position at the upstream side in the sheet carrying direction from the first entrance sensor 4*a*. The predetermined position is less far from the first entrance sensor 4*a* than the medium interval. Since the medium interval is 7 cm, the predetermined position is determined to be 3 cm away from the sensor at the upstream side in the sheet carrying direction. A leading edge Pd2*a* of the sheet Pd2 is stopped and retained at a predetermined position at the upstream side in the sheet carrying direction from the trailing edge Pd1*b* of the sheet Pd1. In the embodiment, the position is 7 cm away from the trailing edge Pd1*b* of the Pd1. In correspondence with the carry of the sheet Pd2, the trailing edge Pd2*b* as well is carried. In a state in which a sheet Pd1 and a sheet Pd2 are fed and retained in the sheet carrying path, in the case where the number of remaining images that is managed by the remaining image managing part 108*a* and the number of fed sheets that is managed by the feeding sheet managing part 108*b* match, the sheets that are retained in the sheet carrying path are used to complete the printing of the print data. By doing so, when the printing operation is completed, sheets that are fed will not remain in the sheet carrying path. Therefore, even when printing is performed in which a sheet of a different kind is used for next print data, in a print operation due to the next print data, when the number of remaining sheets of the sheet feeding tray 1 is equal to or less than a predetermined amount, the sheet feeding controller 106 can feed a sheet from substitute sheet feeding tray 1 that contains the same medium to a predetermined position and let the sheet wait there.

For example, as illustrated in FIG. 9A, sheets that precede two sheets including a sheet PaM that is fed from the sheet feeding tray 1*a* and a leading edge PaMa of a sheet PaN that precedes the sheet PaM and for which secondary transfer has not been performed are during secondary transfer or are after secondary transfer. When there are two sheets for which sheet-feeding has been completed, there are four sheets in total for which sheet-feeding has been completed and that are before secondary transfer. That is, the number of sheets that is managed by the feeding sheet managing part 108*b* is four. Further, when the sum of the number of remaining images of the print data that is managed by the remaining image managing part 108*a* and the number of images for which primary transfer output has been performed (images before being secondarily transferred to sheets) is four, the number of the remaining images and the number of the sheets both are four and match each other. Therefore, the print controller 108 instructs the re-carrying timing generation part 107*a* to generate a re-carrying timing.

Figure 9B:
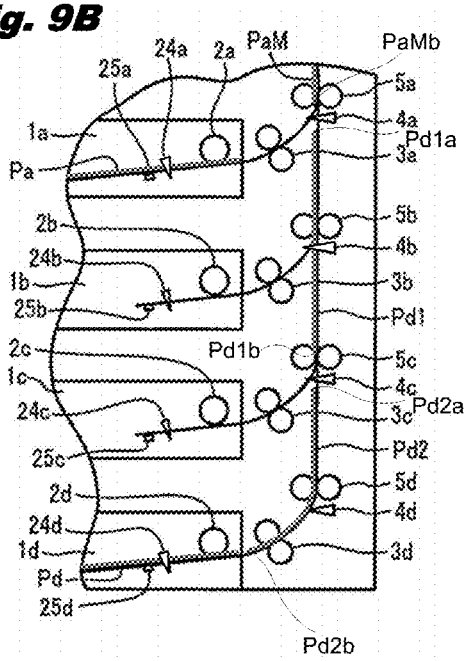

In the following, processing at S39 and S40 in the case where the number of remaining images and the number of fed sheets match is described. Similar to the above-described S39, the re-carrying timing generation part 107*a* uses a final sheet of the sheet feeding tray that is being used in continuous printing and detects a trailing edge of the final sheet using a sensor provided in the sheet carrying path, and generates a re-carrying timing of the sheet that has been fed from the substitute sheet feeding tray to the predetermined position. For example, as illustrated in FIG. 9B, based on a timing when a trailing edge PaMb of the sheet PaM that is fed from the sheet feeding tray 1*a* is detected by the entrance sensor 4*a* (detection of Off of the entrance sensor 4*a*), the re-carrying timing generation part 107*a* generates a re-carrying timing that is a waiting time period for starting re-carrying of the print sheet Pd1 and sheet Pd2 that are fed from the sheet feeding tray 1*d* as the substitute sheet feeding tray.

For example, the leading edge Pd1*a* of the sheet Pd1, which is supplied from the sheet supply tray 1*d*, is carried and stopped after carried up to a predetermined position. The predetermined position is less far from the first entrance sensor 4*a* at the upstream side in the sheet carrying direction than the medium interval. Also, the leading edge Pd2*a* of the sheet Pd2 is stopped at a predetermined position at the upstream side in the sheet carrying direction. The predetermined position is far from the first entrance sensor 4*a* with a predetermined distance, which is for example, the same distance as the medium interval, 7 cm. When a no-sheet detection sensor 24*a* detects the trailing edge PaMb of the sheet PaM passing by the sensor 24*a*, a sheet carrying operation of the sheets Pd1 and Pd2, which has been suspended, is resumed at a timing. The timing is determined to be a required time for which the trailing edge PaMb of the sheet PaM moves 4 cm since the first entrance sensor 4*a* detects the trailing edge PaMb of the sheet PaM passing through the sensor. The moving distance, 4 cm, is calculated based on the carrying distance per unit time or the rotation speed of the registration roller pair 5*a*.

Figure 9C:
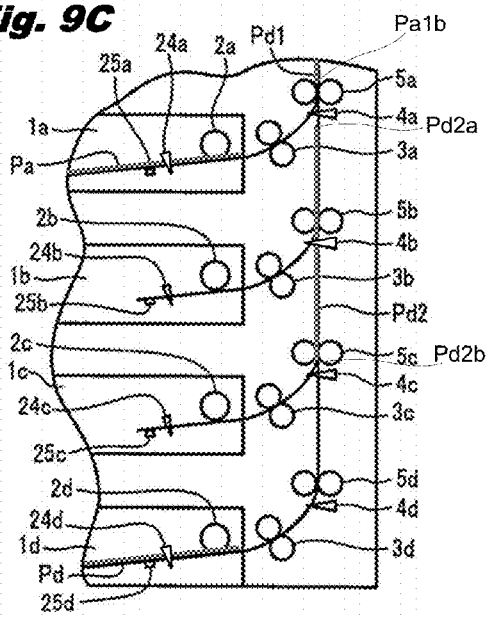

When a time period corresponding to the re-carrying timing that is generated by the re-carrying timing generation part 107*a* has passed, similar to the above-described S40, the re-carrying instructing part 107*b* notifies the sheet feeding operation controller 106*c* of a re-carrying instruction with respect to a sheet that is fed from the substitute sheet feeding tray to a predetermined position. For example, at S39, when a time period corresponding to the re-carrying timing that is generated by the re-carrying timing generation part 107*a* has passed, the re-carrying instructing part 107*b* notifies the sheet feeding operation controller 106*c* of the re-carrying instruction with respect to the sheet Pc1 that is fed from the sheet feeding tray 1*c* to the predetermined position. The sheet feeding operation controller 106*c* that has received the instruction, as illustrated in FIG. 9C, activates the first registration roller pairs 5*b*, 5*c* to perform re-carrying of the sheet Pd1, and also activates the first registration roller pair 5*d* to re-carry the sheet Pd2, and causes the processing to proceed to S41.

As described above, in the present embodiment, when the number of remaining sheets of the sheet feeding tray 1*a* is equal to or less than a predetermined amount, the sheet feeding controller 106 feeds a sheet from substitute sheet feeding tray 1*d* that contains the same medium to a predetermined position and let the sheet wait there. Thereby, even when it is detected that there is no sheet in the sheet feeding tray 1*a* that is used in printing, the sheet that is in waiting can be used to continue a printing operation. Therefore, reduction in printing performance can be suppressed and printing can be performed without wasting toner used in image formation. Further, the sheet feeding controller 106, depending on the number of remaining images, can use a sheet that is fed in advance as a final sheet and terminate printing without causing a sheet to be retained in the apparatus.

As described above, in the present embodiment, an effect is obtained that, when the number of remaining sheets of a sheet feeding tray is equal to or less than a predetermined amount, by feeding a sheet from substitute sheet feeding tray that contains the same medium to a predetermined position and letting the sheet wait there, even when it is detected that there is no sheet in the sheet feeding tray that is being used in printing, reduction in printing performance can be suppressed. Further, an effect is obtained that printing can be performed without wasting toner used in image formation.

Further, an effect is obtained that, depending on the number of remaining images, a sheet that is fed in advance can be used as a final sheet and printing can be terminated without causing a sheet to be retained in the apparatus. In the present embodiment, the image forming apparatus is described as a printer. However, the present invention is not limited to this. The image forming apparatus may also be a facsimile machine, a copying machine, a multifunction machine (MFP), or the like, as long as it includes a sheet feeding tray.

What is claimed is:

1. An image forming apparatus comprising:

a medium container that contains media;

a sheet feeding controller that feeds the media one sheet by one sheet, which is contained in the medium container;

a detection part that detects a remaining amount of the media contained in the medium container;

a searching part that searches for another medium container that contains media that is the same kind as the media contained in the medium container, wherein the sheet feeding controller, when the detection part detects that the remaining amount of the media contained in the medium container has reached a predetermined amount, feeds one of the media, which is contained in the another medium container that is found by the searching part, to a predetermined position, wherein the predetermined amount of the media is greater than zero, and the media that have been carried to the predetermined position is supplied to an image forming part when the remaining amount of the media reaches zero.

2. The image forming apparatus according to claim 1 further comprising a carrying controller that carries the media that is fed by the sheet feeding controller, wherein the carrying controller, when the detection part detects that the media contained in the medium container is used up, carries a final medium that was contained in the medium container and a first subsequent medium that is fed first from the another medium container to the predetermined position in such a manner that a medium interval between the final medium and the first subsequent medium is the same as a medium interval in continuous printing.

3. The image forming apparatus according to claim 2 further comprising a timing generation part that generates a carrying timing of the subsequent medium in such a manner that the medium interval between the final medium and the first subsequent medium is the same as the medium interval in continuous printing, wherein the carrying controller starts to carry the subsequent medium based on the carrying timing.

4. The image forming apparatus according to claim 1 further comprising a print controller that performs printing using the media that is fed to the predetermined position based on a number of media that is fed from the another medium container and a number of remaining images of print data.

5. The image forming apparatus according to claim 4, wherein the print controller, before the media contained in the medium container is used up, performs printing using the media that is fed to the predetermined position when it is judged that the remaining images of the print data can be printed using media fed from the another medium container.

6. The image forming apparatus according to claim 1, wherein the searching part executes searching of the another medium container when the detection part detects that the remaining amount of the original sheet has reached the predetermined amount.

7. The image forming apparatus according to claim 1, wherein the searching part executes searching of the another medium container based on the remaining amount of media contained in the medium container and a number of images to be formed.

8. The image forming apparatus according to claim 1, further comprising a sensor that detects carrying of the media carried from the another medium container, the sensor being provided on a carrying path of the medium carried from the another medium container, and wherein the predetermined position is arranged at upstream of the sensor in the carrying path.

9. An image forming apparatus that continuously forms images on a plurality of media, comprising:

a first medium container that contains media on which the images are formed;

a second medium container that supplies media in place of the first medium container, the media contained in the second medium container being of the same kind as the media contained in the first medium container;

a receiving part that receives image data of the images;

a carrying controller that carries a medium contained either in the first medium container or the second medium container based on the image data; and an image forming part that forms an image on a medium that is carried based on the image data, wherein when the receiving part receives the image data, the carrying controller carries a medium contained in the second medium container to a predetermined position before the media contained in the first medium container is used up, the carrying controller, in middle of printing using the media supplied from the first medium container and in a state in which there is a medium remaining in the first medium container, carries the medium that was carried in advance from the second medium container and performs an image-formation of at least a last page of print data, which is generated from the image data, on the medium from the second medium container, and when a number of medium that has been carried from the second medium container in advance becomes equal to a number of medium for forming remaining images, the medium that has been carried from the second medium container in advance is used to form the remaining images.

10. The image forming apparatus according to claim 9, wherein the kind of medium is at least one of size and thickness of the medium.

11. The image forming apparatus according to claim 9, further comprising a sensor that detects carrying of the media carried from the second medium container, the sensor being provided on a carrying path of the second medium, and wherein the predetermined position is arranged at upstream of the sensor in the carrying path.

12. The image forming apparatus according to claim 9, wherein the media that have been carried to the predetermined position is supplied to the image forming part when the remaining amount of the media reaches zero.

13. An image forming apparatus that forms images on sheets at an image forming section, comprising:

a plurality of sheet trays that contain and supply the sheets, each of the sheets being carried through a sheet carrying path from the sheets trays to the image forming section;

a sheet feeding controller that feeds the sheets from one of the sheet supply trays to the sheet path, the supplying sheet tray being selected based on an image data to be printed and designated as an original sheet tray, the contained sheets therein being as original sheets;

a detection part that detects a number of the original sheets contained in the original sheet tray is smaller than a predetermined number;

a searching part that searches for another sheet tray, which is other than the original sheet tray, containing sheets that are at least of the same width as that of the original sheets contained in the original sheet tray, the another sheet tray being designated as a substitute sheet tray and the contained sheets therein being designated as substitute sheets, wherein the sheet feeding controller, when the detection part detects that the number of the original sheets has become small, feeds one of the substitute sheets as a first substitute sheet to set the sheet at a predetermined position before the original sheets are used up so that the image forming apparatus continues to feed the first substitute sheet to the image forming section with a substitute medium interval (MIs) after a final original sheet is fed to the image forming section, the substitute medium interval being the same as a normal medium interval (MIn) that is defined as a distance between a final original sheet and a second final original sheet that is fed prior to the final original sheet, and the media that have been carried to the predetermined position is supplied to the image forming part when a remaining amount of the media in the original sheet tray reaches zero.

14. The image forming apparatus according to claim 13, wherein the searching part executes searching of the another sheet tray when the detection part detects that the remaining amount of the original sheet has reached the predetermined amount, and wherein the predetermined amount is greater than zero.

15. The image forming apparatus according to claim 13, wherein the searching part executes searching of the another sheet tray when the number of the original sheets contained in the original sheet tray and a number of images to be formed.

16. The image forming apparatus according to claim 13, further comprising a sensor that detects carrying of the sheet carried from the another sheet tray in a carrying path, and wherein the predetermined position is arranged at upstream of the sensor in the carrying path.

17. An image forming apparatus that continuously forms images on a plurality of media, comprising:

a first medium container that contains media on which the images are formed;

a second medium container that supplies media in place of the first medium container, the media contained in the second medium container being of the same kind as the media contained in the first medium container;

a receiving part that receives image data of the images;

a carrying controller that carries a medium contained either in the first medium container or the second medium container based on the image data; and an image forming part that forms an image on a medium that is carried based on the image data, wherein when the receiving part receives the image data, the carrying controller carries a medium contained in the second medium container to a predetermined position before the media contained in the first medium container is used up, the carrying controller, in middle of printing using the media supplied from the first medium container and in a state in which there is a medium remaining in the first medium container, carries the medium that was carried in advance from the second medium container and performs an image-formation of at least a last page of print data, which is generated from the image data, on the medium from the second medium container, and the media that have been carried to the predetermined position is supplied to the image forming part when the remaining amount of the media reaches zero.

18. The image forming apparatus according to claim 17, wherein the kind of medium is at least one of size and thickness of the medium.

19. The image forming apparatus according to claim 17, further comprising a sensor that detects carrying of the media carried from the second medium container, the sensor being provided on a carrying path of the second medium, and wherein the predetermined position is arranged at upstream of the sensor in the carrying path.

* * * * *